United States Patent [19]

Amano

[11] Patent Number: 4,526,080

[45] Date of Patent: Jul. 2, 1985

[54] AUTOMATIC RHYTHM PERFORMING APPARATUS

[75] Inventor: Takehisa Amano, Thomaston, Ga.

[73] Assignee: Nippon Gakki Seizo Kabushiki Kaisha, Hamamatsu, Japan

[21] Appl. No.: 546,893

[22] Filed: Oct. 31, 1983

[30] Foreign Application Priority Data

Nov. 4, 1982 [JP] Japan ..... 57-193667

[51] Int. Cl.[3] ..... G10H 1/42; G10H 1/46; G10H 7/00

[52] U.S. Cl. ..... 84/1.03; 84/1.27; 84/DIG. 10; 84/DIG. 12

[58] Field of Search ..... 84/1.03, 1.27, DIG. 10, 84/DIG. 12; 381/102, 118

[56] References Cited

U.S. PATENT DOCUMENTS

| | | | |
|---|---|---|---|
| 3,668,322 | 6/1972 | Allen et al. | 381/102 |
| 3,919,911 | 11/1975 | Nakata et al. | 84/1.27 |
| 3,972,258 | 8/1976 | Adachi | 84/1.03 |
| 4,151,368 | 4/1979 | Fricke et al. | 84/DIG. 10 |
| 4,305,319 | 12/1981 | Linn | 84/1.27 X |

*Primary Examiner*—S. J. Witkowski

*Attorney, Agent, or Firm*—Spensley Horn Jubas & Lubitz

[57] ABSTRACT

An automatic rhythm performing apparatus capable of simultaneously producing a plurality of rhythmic tones having the optimum volume relationship irrespective of the total volume of the rhythmic tones. A plurality of rhythmic tone signal generating devices generate a plurality of rhythmic tone signals corresponding respectively to a plurality of rhythmic musical instruments. A combining device combines the rhythmic tone signals to provide a combined output signal as an output of this apparatus, the level of which can be varied by a signal level varying device. There are provided a detecting device for detecting the level of the combined output signal and a controlling device for separately controlling respective signal levels of the rhythmic tone signals in accordance with the detected level of the combined output signal, thereby making the volume relationship of the plurality of the rhythmic tones optimum.

8 Claims, 9 Drawing Figures

AUTOMATIC RHYTHM PERFORMING APPARATUS

BACKGROUND OF THE INVENTION

1. Field of the Invention

This invention relates generally to an electronic musical instrument and particularly to an automatic rhythm performing apparatus by which a plurality of rhythmic tones corresponding respectively to a plurality of rhythmic musical instruments are produced at a time.

2. Prior Art

There has been proposed a conventional automatic rhythm performing apparatus in which the total volume of a plurality of rhythmic tones produced at a time is varied by one control device such as a variable resistor. When performing music through a musical instrument with this conventional apparatus, the performer can vary the total volume of the rhythmic tones through the variable resistor. This conventional apparatus is disadvantageous however in that the volumes of the rhythmic tones are varied at the same rate when the total volume of the rhythmic tones is varied. This can worsen the musical balance of the respective rhythmic tones in certain kinds of rhythms to make the rhythmic tones sound odd.

According to experiment conducted by the inventor, Table 1 shows the optimum volume relationships of eight-beat rhythmic tones at specific total volume levels which tones comprise a high-hat cymbals tone (closed), a high-hat cymbals tone (open), a snare drum tone and a bass drum tone.

TABLE 1

| | pp | p | mp | mf | f | ff |
|---|---|---|---|---|---|---|
| High-hat cymbals (closed) | 0 | 0 | 0 | 0 | 0 | 0 |
| High-hat cymbals (open) | −10 | −4 | −2 | 0 | −2 | 0 |
| Snare drum | −10 | −4 | −4 | 0 | 0 | +2 |
| Bass drum | −12 | −4 | −6 | 0 | 0 | +4 |

Wherein each value is expressed in dB.

In this table, the volume level of each of the four rhythmic tones at the total volume level of mezzo-forte (mf) is used as a reference for determining the volume levels of its corresponding rhythmic tone at the total volumes other than mezzo-forte. The volume level of each of the four rhythmic tones at each of the total volume levels other than mezzo-forte such as forte (f) and mezzo-piano (mp) is indicated in the corresponding column of this Table 1 in which the volume level of the closed high-hat cymbals tone is used as a reference.

It will be understood from this Table 1 that when the total volume is varied from mezzo-forte (mf) to forte (f), the volume level of the closed high-hat cymbals tone should be decreased by 2 dB in order to maintain the optimum volume relationship although the volume levels of the snare drum tone and the bass drum tone need not be varied. On the other hand, when the total volume is adjusted to fortissimo (ff), the volume levels of the snare drum tone and the bass drum tone should be increased by 2 dB and 4 dB, respectively.

As described above, the optimum volume relationship of the respective rhythmic tones is varied in accordance with the variation of the total volume thereof. Therefore, if the volumes of the rhythmic tones are varied only through one variable resistor for controlling the total volume thereof, the volume relationship of the rhythmic tones is worsened, so that the rhythmic tones generated sound odd.

SUMMARY OF THE INVENTION

It is therefore an object of this invention to provide an automatic rhythm performing apparatus in which the optimum volume relationship of a plurality of rhythmic tones is attained even when the total volume of the rhythmic tones is varied.

According to one aspect of the present invention, there is provided an automatic rhythm performing apparatus comprising: a plurality of means each for generating a rhythmic tone signal of a specific rhythmic musical instrument; means for combining outputs of the plurality of tone signal generating means thereby to provide a combined output signal as an output of this apparatus; means for varying signal level of the combined output signal level; means for detecting the signal level of the combined output signal; and means responsive to the detecting means for controlling respective output signal levels of the rhythmic tone signal generating means separately from each other in response to the detected level of the combined output signal.

DESCRIPTION OF THE PREFERRED EMBODIMENTS OF THE INVENTION

Figure 1:
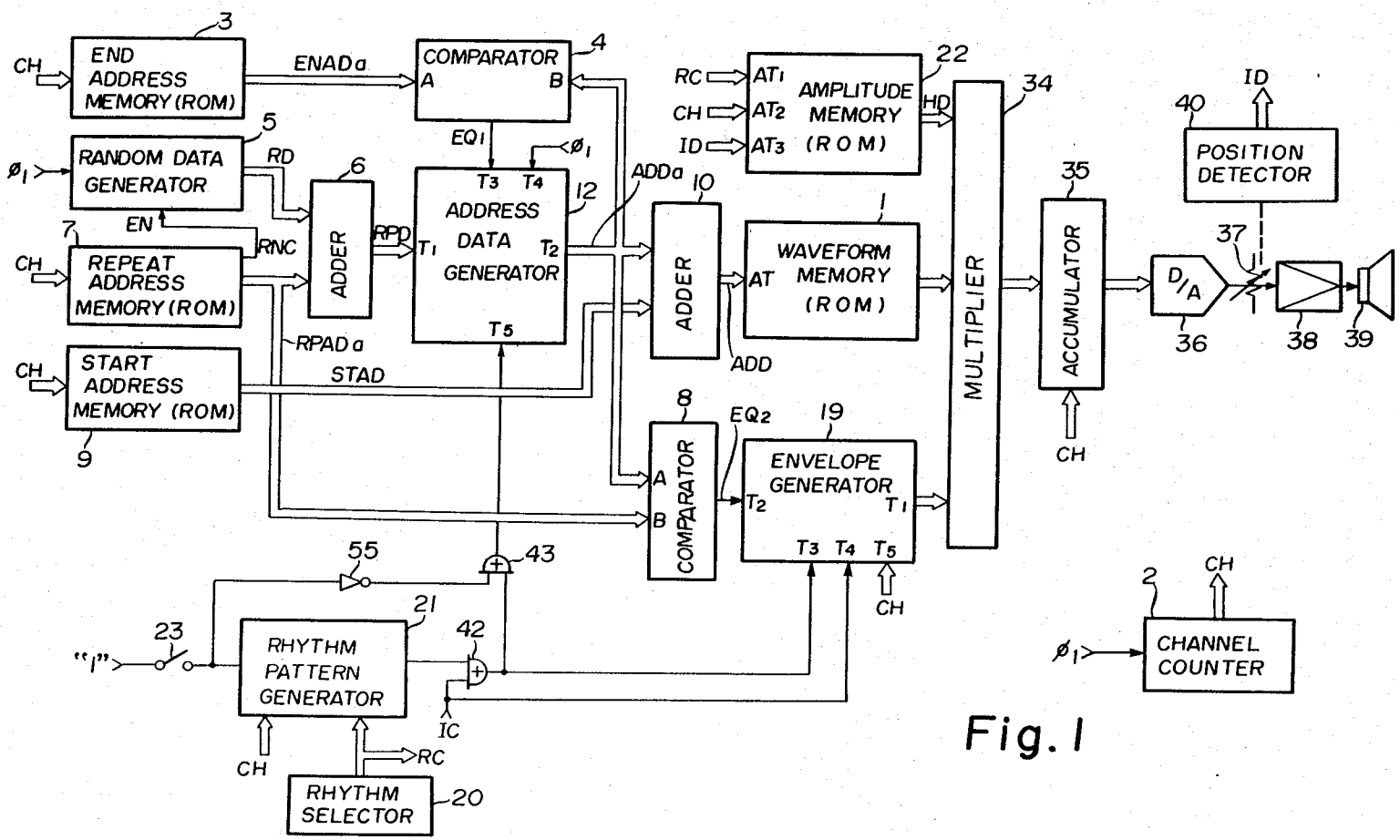
FIG. 1 is a block diagram of an automatic rhythm performing apparatus according to the present invention.
Figure 2:
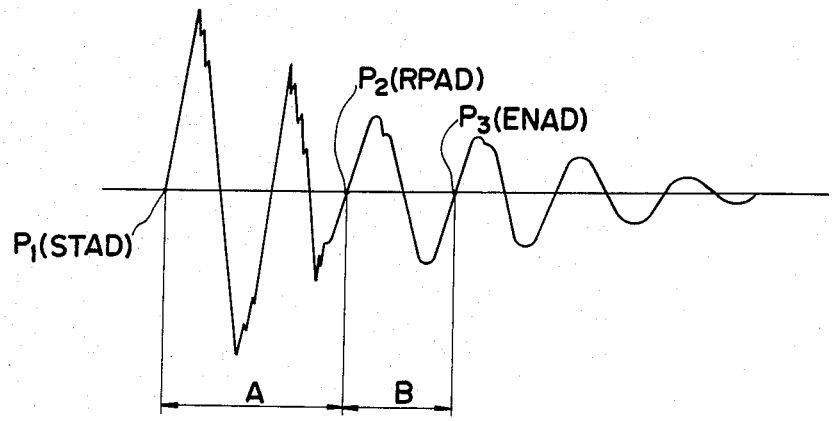
FIG. 2 is a diagrammatical illustration showing a waveform of a rhythmic tone.

FIG. 1 is a block diagram of an automatic rhythm performing apparatus according to an embodiment of the present invention which may be used as either an independent apparatus or an apparatus incorporated in a musical instrument such as an electronic keyboard musical instrument. This automatic rhythm performing apparatus comprises a waveform memory 1 in which waveforms of sixteen kinds of rhythmic tones are stored. With this arrangement, associated circuits of this apparatus are operated in a time-sharing manner to produce the sixteen kinds of rhythmic tones simultaneously. The waveform of each of the sixteen rhythmic tones is stored in the memory 1 in the form of digital data representing not whole but a certain portion thereof. More specifically, with reference to FIG. 2 illustrating wave form of such a rhythmic tone, preselected instantaneous values of the attack portion A of the waveform are converted into digital data which in turn are stored in the waveform memory 1 consecutively in a predetermined area thereof. Also, preselected instantaneous values of the portion B or one cycle following the portion A of the waveform are converted into digital data which in turn are stored in the other area of the memory 1 following the area in which the instantaneous values of the attack portion A are stored. When it is required to form the rhythmic tone, the data representative of the instantaneous values of the attack portion A are sequentially read out of the memory 1 first and then the data representative of the instantaneous values of the portion B are repetitively read out of the memory 1. An amplitude envelope is then applied to those read out data to form the rhythmic tone. The above-described manner in which the data are stored in the wave memory 1 is helpful to reduce the capacity thereof.

In FIG. 1, a channel counter 2 is a binary four-stage counter for counting up clock pulses $\emptyset_1$, and the output of this counter 2 which varies in the range of "0" to "15" is applied to the associated circuits as a channel signal CH. The values "0" to "15" of the channel signal CH correspond to the following rhythmic tones, respectively:

| | |
|---|---|
| 0: | high-hat cymbals tone (closed) |
| 1: | high-hat cymbals tone (open) |
| 2: | snare drum tone |
| 3: | bass drum tone |
| 4: | high conga tone |
| 5: | low conga tone |
| | . |
| | . |
| | . |
| 15: | cabasa tone |

The associated circuits are operated in accordance with the values of the channel signal CH to form the respective rhythmic tones.

Figure 3:
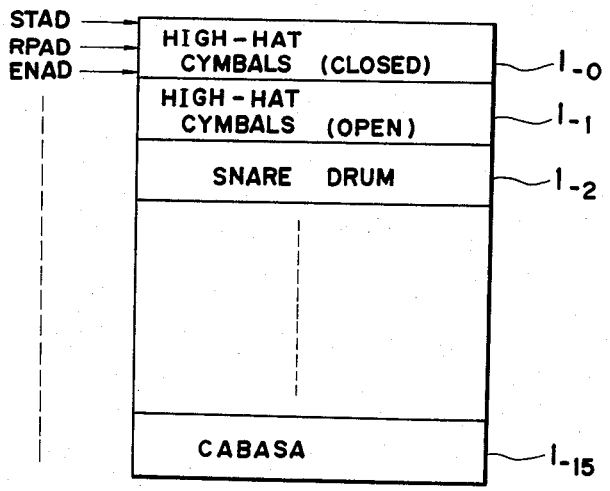
FIG. 3 is an illustration showing the waveform memory of the apparatus of FIG. 1.

Waveform memory 1, as shown in FIG. 3, comprises a ROM having sixteen storage areas $\mathbf{1}_{-0}$ to $\mathbf{1}_{-15}$ in which data representative of the above-mentioned sixteen kinds of rhythmic tone waveforms are stored, respectively. In this case, the data representative of the closed high-hat cymbals tone is stored in the area $\mathbf{1}_{-0}$, the data representative of the open high-hat cymbals tone in the area $\mathbf{1}_{-1}$, the data representative of the snare drum tone in the area $\mathbf{1}_{-2}, \ldots$, and the data representative of the cabasa tone in the area $\mathbf{1}_{-15}$, respectively. The respective waveform data stored in this memory 1 are read therefrom in accordance with address data ADD which is applied to the address input terminal AT thereof. The lowest address of each one of the areas $\mathbf{1}_{-0}$ to $\mathbf{1}_{-15}$ in which the data representing an instantaneous value at the beginning point $P_1$ of the portion A (See FIG. 2) is stored is hereinafter referred to as start address STAD. The address of each one of the areas $\mathbf{1}_{-0}$ to $\mathbf{1}_{-15}$ in which the data representing an instantaneous value at the beginning point $P_2$ of the portion B is stored is hereinafter referred to as repeat address RPAD while the address in which the data representing an instantaneous value at the ending point $P_3$ of the portion B is stored is hereinafter referred to as end address ENAD.

An end address memory 3 comprises a ROM storing data representative of relative end addresses ENADa of the sixteen kinds of rhythmic tone waveforms stored in the waveform memory 1. Each relative end address ENADa is a value obtained by subtracting the actual start address STAD from the actual end address ENAD of each one of the areas $\mathbf{1}_{-0}$ to $\mathbf{1}_{-15}$. This memory 3 is addressed by the channel signal CH to output data representative of relative end address ENADa of the selected waveform to an input terminal A of a comparator 4.

A random data generator 5 generates a random data RD which varies randomly in value and sign each time a clock pulse $\emptyset_1$ is applied thereto. When "1" signal is applied to an enabling terminal EN, this random data generator 5 supplies the random data RD to one input terminal of an adder 6. When "0" signal is applied to the enabling terminal EN, the random data generator 5 supplies data representative of "0" to the one input terminal of the adder 6.

A repeat address memory 7 comprises a ROM storing data representative of relative repeat addresses RPADa of the sixteen kinds of waveforms stored in the waveform memory 1. Each relative repeat address RPADa is a value obtained by subtracting the actual start address STAD from the actual repeat address RPAD of each one of the areas $\mathbf{1}_{-0}$ to $\mathbf{1}_{-15}$. This memory 7 is addressed by the channel signal CH to output data representative of relative repeat address RPADa of the selected waveform to the other input terminal of the adder 6 and an input terminal B of a comparator 8. The memory 7 also stores data for forming a control signal RNC which represents "1" or "0" in accordance with the rhythmic tones, the control signal RNC being used to control the random data generator 5. The data is read from the memory 7 to form the control signal RNC in accordance with the channel signal CH, and the control signal RNC is applied to the enabling terminal EN of the random data generator 5. The generation of the random data RD is desired with respect to some rhythmic tones and is not desired with respect to the others. This is the reason why the control signal RNC should be provided. For example, in the case of the cymbals tone, the control signal RNC is rendered "1", and the random data RD is outputted from the random data generator 5.

Start address memory 9 comprises a ROM storing data representative of the start addresses STAD of the rhythmic tone waveforms stored in the waveform memory 1. This start address memory 9 is addressed by the channel signal CH to output the start address STAD of the selected waveform to one input terminal of an adder 10.

The adder 6 functions to add the output data RD of the random data generator 5 to the relative repeat address data RPADa and outputs repeat address data RPD representative of the result of this addition to an input terminal T1 of an address data generator 12.

Figure 4:
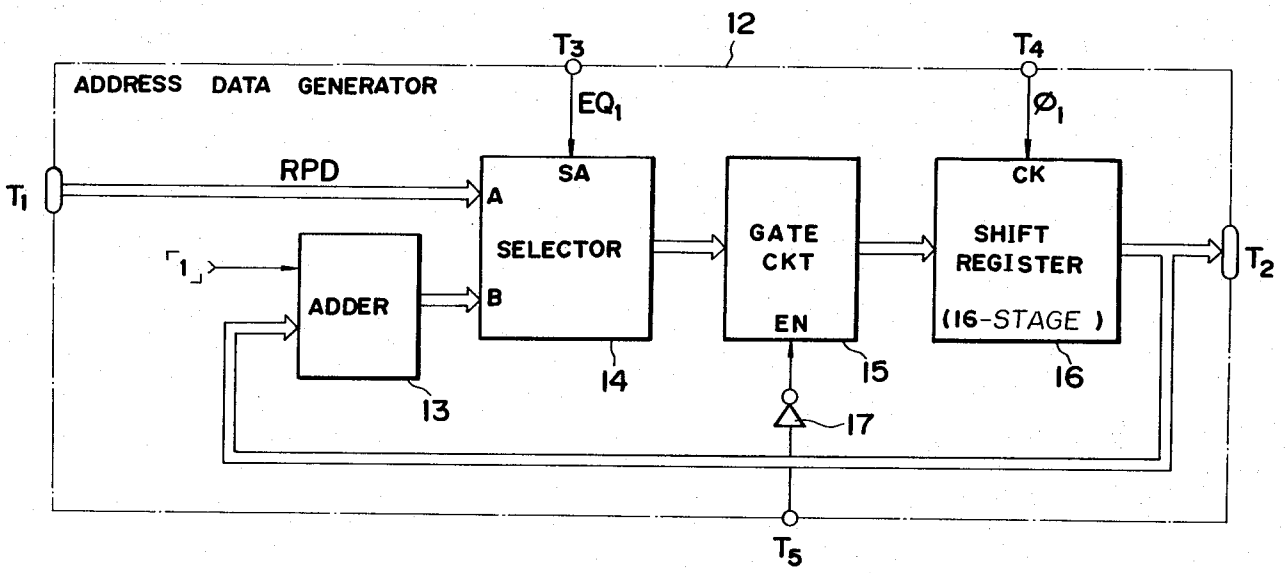
FIG. 4 is a detailed block diagram of the address data generator of the apparatus of FIG. 1.

The address data generator 12 comprises an adder 13, a selector 14, a gate circuit 15, a shift register 16 and an inverter 17 as shown in FIG. 4. The adder 13 adds "1" to the output data of the shift register 16. The selector 14 selects one of the data applied to its input terminal A and input terminal B in accordance with a signal applied to its selector terminal SA, and outputs the selected data. The gate circuit 15 is opened when "1" signal is applied to its enabling terminal EN, and is closed when "0" signal is applied to the enabling terminal EN. The shift register 16 is a sixteen-stage shift register in which data in each stage is shifted into the next stage by a clock pulse $\emptyset_1$. The output data of this shift register 16 is supplied through a terminal $T_2$ to the input terminal B of the comparator 4, the other input terminal of the adder 10 and an input terminal A of the comparator 8.

The comparator 4 compares the relative end address data ENADa with the address data ADDa, and outputs a coincidence signal EQ1 to an input terminal $T_3$ of the address data generator 12 when the two data coincide with each other. The adder 10 adds the address data ADDa to the start address data STAD and outputs address data ADD representative of the result of this addition to the address input terminal AT of the waveform memory 1. The comparator 8 compares the address data ADDa with the relative repeat address data RPADa, and outputs a coincidence signal EQ2 to an input terminal $T_2$ of an envelope generator 19 when the two data coincide with each other.

A rhythm selector 20 comprises a plurality of switches for selecting a desired kind of rhythm among a plurality of rhythms such as rhumba, eight-beat and samba. The rhythm selector 20 also comprises an encoder for converting the output of the actuated switch into a rhythm code data RC representing the selected rhythm. The rhythm code data RC outputted from the encoder is supplied to a rhythm pattern generator 21 and an amplitude memory 22.

The rhythm pattern generator 21 generates sixteen kinds of rhythm pulses corresponding respectively to the sixteen kinds of rhythmic tones. The pattern of each rhythm pulse (the pattern is hereinafter referred to as a rhythm pattern) is determined by the rhythm code data RC. Each rhythm pulse is generated by turning on a rhythm switch 23 and is stopped by turning off the switch 23. Each rhythm pulse so generated is outputted from the rhythm pattern generator 21 in a time-sharing manner in accordance with the channel signal CH. More specifically, the rhythm pulse representative of the closed high-hat cymbals is outputted when the channel signal CH is "0", the rhythm pulse representative of the open high-hat cymbals is outputted when the channel signal CH is "1", . . . , and the rhythm pulse representative of the cabasa is outputted when the channel signal CH is "15".

Figure 5:
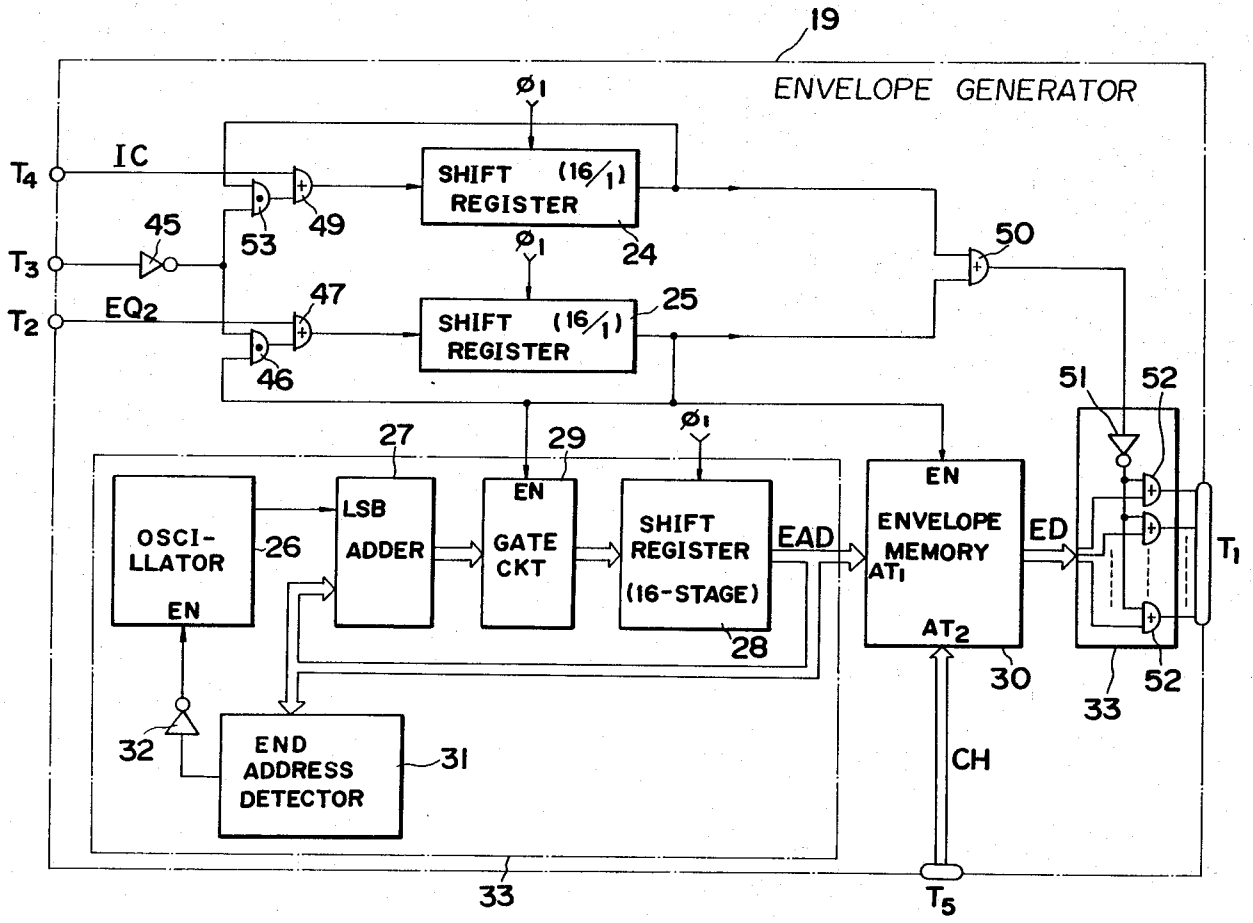
FIG. 5 is a detailed block diagram of the envelope generator of the apparatus of FIG. 1.

The envelope generator 19 will now be described with reference to FIG. 5. Reference numerals 24 and 25 designate one-bit sixteen-stage shift registers in which data in each stage is shifted by a clock pulse $\emptyset_1$. An oscillator 26 generates a pulse signal ("1" signal) having a pulse width of $16\emptyset_1$ and a period of $16\emptyset_1 \times n$. When "1" signal is being applied to an enabling terminal EN of the oscillator 26, it outputs the generated pulse signal to the LSB terminal of one data input terminal of an adder 27. When "0" signal is being applied to the enabling terminal EN, the oscillator 26 outputs "0" signal. The adder 27 adds the output data of a shift register 28 to the output signal of the oscillator 26 and feeds an output to the shift register 28 throuth a gate circuit 29. The terminals of the one data input terminal of the adder 27 other than the LSB terminal are grounded. In other words, when the output signal of the oscillator 26 is "1" the adder 27 adds "1" to the output data of the shift register 28, and when the output signal of the oscillator 26 is "0" the adder 27 adds "0" to the output data of the shift register 28. The shift register 28 is of such a type that the data in each stage is shifted by a clock pulse $\emptyset_1$, and this shift register 28 outputs address data EAD to an address input terminal $AT_1$ of an envelope memory 30, the other data input terminal of the adder 27 and an end address detector 31. The end address detector 31 is responsive to the output data of the shift register 28 of "1 1 . . . 1 1" and outputs "1" signal to an input terminal of an inverter 32. Thus, the above-mentioned components 26 to 29, 31 and 32 constitute an envelope counter 33 which is operated in a time-sharing manner.

Figure 6:
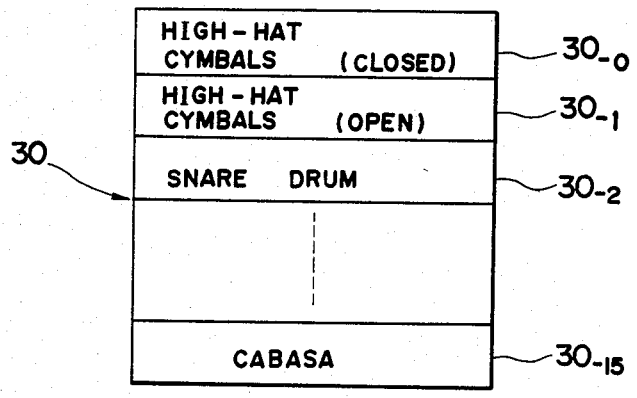
FIG. 6 is an illustration showing the envelope memory of the envelope generator of FIG. 5.

The envelope memory 30 comprises sixteen storage areas $30_{-0}$ to $30_{-15}$, as shown in FIG. 6, in which envelope data ED corresponding respectively to the sixteen kinds of rhythmic tones are stored. In this case, the maximum value "1 1 . . . 1 1" of each envelope data ED is stored in the start address of each of the areas $30_{-0}$ to $30_{-15}$, and the envelope data ED stored in each of the areas $30_{-0}$ to $30_{-5}$ is reduced gradually from the start address thereof. Also, data representative of "0" is stored in the end address of each of the areas $30_{-0}$ to $30_{-15}$. The envelope memory 30 is addressed by both address data EAD applied to its address input terminal AT1 and the channel signal CH applied to its address input terminal AT2. In other words, the channel signal CH designates one of the areas $30_{-0}$ to $30_{-15}$, and the address data EAD designates one of the addresses in the designated area. For example, when the channel signal CH represents "3" and when the address data EAD represents "0", the start address of the area $30_{-3}$ is designated. The envelope data ED so read out through the above-mentioned addressing is applied to a first data input terminal of a multiplier 34 through an OR gate circuit 33 and a terminal T1. When "1" signal is being applied to the enabling terminal EN of the envelope memory 30 the envelope data ED is read therefrom, and when "0" signal is being applied to the enabling terminal EN the data representative of "0" is read therefrom.

The multiplier 34 multiplies the output data of the waveform memory 1 by the output data of the envelope generator 19 and then multiplies the data representing the result of the multiplication by an output data of the amplitude memory 22. The multiplier 34 feeds the data representative of the result of these multiplications to an accumulator 35. The amplitude memory 22 will be explained in more detail later in this description. The accumulator 35 sequentially accumulates the output data of the multiplier 34 during a period of time when the channel signal CH applied thereto varies from "0" to "15", and latches the result of this accumulation and also output the latched data to a digital-to-analog converter 36. Then, the accumulator 35 again accumulates the output data of the multiplier during the next period when the channel signal CH varies from "0" to "15", and latches the accumulated data after clearing the data latched previously. Then, the above-mentioned operation is repeated. The digital-to-analog converter 36 converts the output data of the accumulator 35 into an analog signal and feeds it to a loudspeaker 39 through a variable resistor 37 and an amplifier 38. The variable resistor 37 functions to vary the signal level of the analog signal, i.e., the total volume of the rhythmic tones.

The variable resistor 37 is provided with a position detector 40 for detecting the position of a slider thereof. The position detector 40 comprises a variable resistor operatively connected to the variable resistor 37. These two variable resistors may be constituted by one double variable resistor. A DC voltage V is applied across the variable resistor of the position detector 40. The position detector 40 also comprises a voltage detector for detecting the voltage appearing at the slider of the variable resistor thereof and an encoder for converting the detected voltage into a digital data. The encoder functions in such a manner that it outputs a data representative of "000" when the detected voltage is in the range of 0 to V/6, outputs a data representative of "001" when the detected voltage is in the range of V/6 to 2V/6, . .

. , and outputs a data representative of "101" when the detected voltage is in the range of 5V/6 to V. The position detector 40 feeds the code data outputted from the encoder to the amplitude memory 22 as a position data ID. In this case, the position data ID outputted from the position detector 40 represents "000" when the position of the slider of the variable resistor 37 corresponds to the volume level of pianissimo, represents "001" when the position corresponds to the volume level of piano, . . . , and represents "101" when the position corresponds to the volume level of fortissimo.

Figure 7:
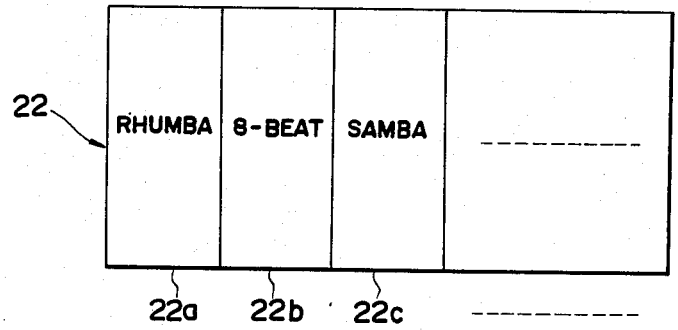
FIG. 7 is an illustration showing the amplitude memory of the apparatus of FIG. 1.

The amplitude memory 22 comprises a ROM in which correction data HD corresponding respectively to the aforementioned rhythms are stored. One of the correction data HD is used for the correction of volume relationships of the respective rhythmic tones when the total volume of the rhythmic tones is varied through the variable resistor 37. The amplitude memory 22, as shown in FIG. 7, comprises a plurality of storage areas *22a*, *22b*, . . . corresponding respectively to the rhythms in each of which correction data corresponding to each of the sixteen rhythmic tones and each of the six specific levels of total volume of the rhythmic tones is stored. For example, the data indicated in Table 1, which corresponds to eight-beat, is stored in the area *22b* in the form of linear data. In this area *22b*, there is also stored data for correction of the volume relationships of the other twelve rhythmic tones corresponding to eight-beat in the manner described above. One of the areas *22a*, *22b*, . . . is designated in accordance with the rhythm code data RC applied to an address input terminal AT1 of this amplitude memory 22 and one of the sixteen rhythmic tones is designated in accordance with the channel signal CH applied to its address input terminal AT2, and one of the six levels of total volume of the rhythmic tones is designated in accordance with the position data ID applied to its address input terminal AT3. The correction data HD so designated as described above is read from the amplitude memory 22 and is supplied to second data input terminal of the multiplier 34.

The operation of this apparatus in the condition where the rhythm code data RC represents eight-beat will now be described.

When a power source (not shown) for this apparatus is turned on, the clock pulses $\emptyset_1$ are applied to the relevant circuits, and an initial clear circuit (not shown) outputs an initial clear signal IC ("1" signal) having a pulse width which is longer than sixteen periods of the clock pulse $\emptyset_1$. The initial clear signal IC is applied to a terminal T5 of the address data generator 12 via OR gates 42 and 43 (See FIG. 1) and also to a terminal T3 of the envelope generator 19 via the OR gate 42. This initial clear signal IC is also applied to a terminal T4 of the envelope generator 19. When the initial clear signal IC ("1" signal) is applied to the terminal T5 of the address data generator 12, the inverter 17 (FIG. 4) outputs "0" signal to the enabling terminal EN of the gate circuit 15. As a result, the gate circuit 15 is closed and therefore the output data of the gate circuit 15 is rendered "0", so that all of the stages of the shift register 16 are cleared. When the initial clear signal IC is applied to the terminal T3 of the envelope generatore 19, an inverter 45 (FIG. 5) outputs "0" signal to one input terminal of an AND gate 46, so that the AND gate 46 outputs "0" signal to one input terminal of an OR gate 47. At this time, "0" signal is being supplied from the comparator 8 (FIG. 1) to the other input terminal of the OR gate 47, so that the OR gate 47 outputs "0" signal to an input terminal of the shift register 25. As a result, each stage of this shift register is cleared, so that "0" signal is outputted from its output terminal. When the "0" signal outputted from the shift register 25 is applied to an enabling terminal EN, the gate circuit 29 is closed to output data representative of "0" to the data input terminal of the shift register 28. As a result, all of the stages of the shift register 28 are cleared. The "0" signal outputted from the shift register 25 is also applied to the enabling terminal of the envelope memory 30, so that this envelope memory is disenabled to output data representative of "0" from the data output terminal thereof.

When the initial clear signal IC is applied to the terminal T4 of the envelope generator 19, an OR gate 49 (FIG. 5) outputs "1" signal to an input terminal of the shift register 24, so that data representative of "1" is inputted to each stage of the shift register 24. Therefore, the shift register 24 outputs "1" signal from its output terminal to an input terminal of an inverter 51 of the OR gate circuit 33 via an OR gate 50, so that the inverter 51 outputs "0" signal to each of one input terminals of OR gates 52 incorporated in the OR gate circuit 33. At this time, "0" signal is being applied to each of other input terminals of the OR gates 52 from the envelope memory 30, so that the OR gate circuit 33 outputs data representative of "0" to the first data input terminal of the multiplier 34 to render the output data thereof "0", which means that no sound is generated by the loudspeaker 39.

When the initial clear signal IC is rendered "0", the inverter 45 outputs "1" signal to each of the one input terminals of the AND gates 46 and 53, so that the data in each stage of the shift register 24 is circulated from its output terminal to its input terminal through the AND gate 53 and the OR gate 49. The same is true with the shift register 25.

On the other hand, when the rhythm switch 23 (FIG. 1) is in the OFF state, "0" signal is applied to an input terminal of an inverter 55, so that the inverter 55 outputs "1" signal to the terminal T5 of the address data generator 12 through the OR gate 43. As a result, "0" signal is applied to the enabling terminal EN of the gate circuit 15, so that the gate circuit 15 outputs data representative of "0" to the shift register 16. In other words, when the rhythm switch 23 is in the OFF state, each stage of the shift register 16 is cleared.

When the rhythm switch 23 is turned on, sixteen kinds of rhythm pulses determined by the output code data of the rhythm selector 20 or rhythm code RC are generated in the rhythm pattern generator 21 and are outputted in a time-sharing manner in accordance with the channel signal CH.

Figure 8:
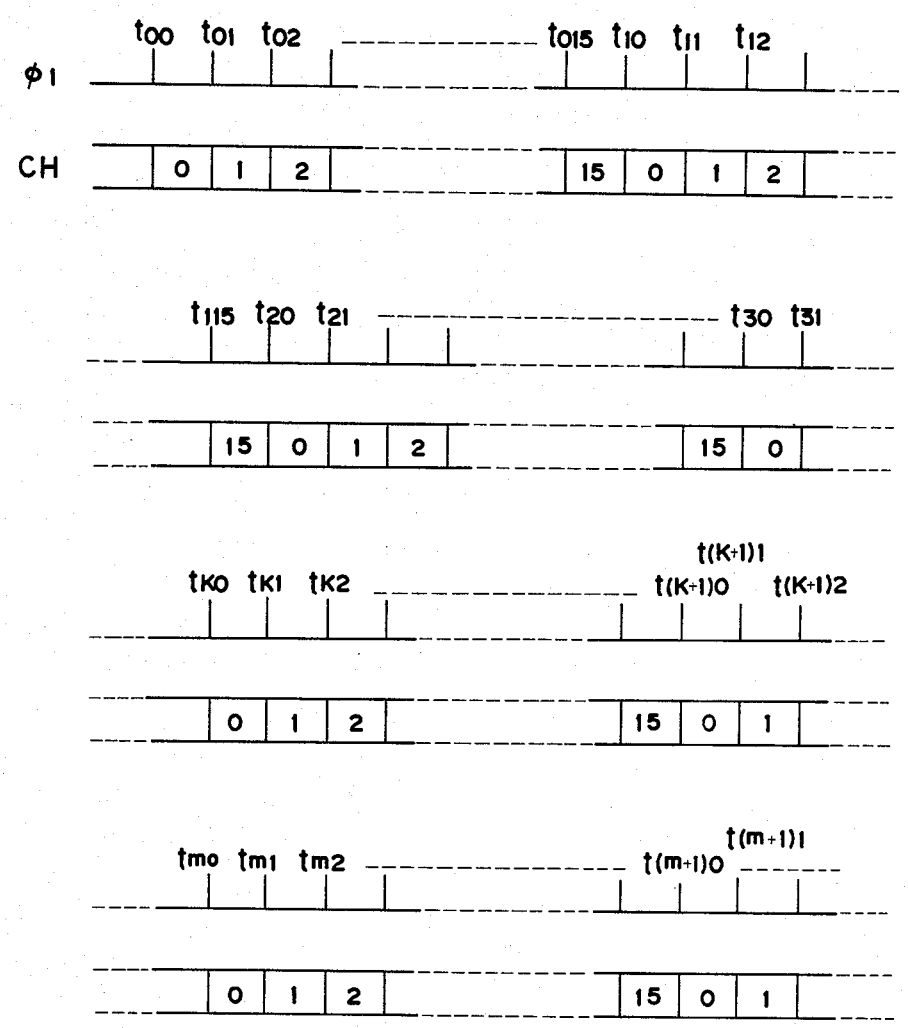
FIG. 8 is a time chart for a clock pulse $\emptyset_1$ and a channel signal CH used in the apparatus of FIG. 1.

In a time chart shown in FIG. 8, when the channel counter 2 outputs the channel signal CH representative of "0" at time $t_{00}$, the rhythm pattern generator 21 outputs rhythm pulses representative of the closed high-hat cymbals tone. If this rhythm pulse is "0" signal during a time period between time $t_{00}$ and time $t_{01}$, the closed high-hat cymbals tone is not formed. On the other hand, if the rhythm pulse is "1" signal during this time period, the closed high-hat cymbals tone is formed.

When the rhythm pattern generator 21 outputs "1" signal during the time period between time $t_{00}$ and time $t_{01}$, the "1" signal is applied to the terminal T5 of the address data generator 12 via the OR gates 42 and 43 and also to the terminal T3 of the envelope generator 19 via the OR gate 42. When the "1" signal is applied to the terminal T5 of the address data generator 12, the inverter 17 (FIG. 4) outputs "0" signal to the gate circuit 15, so that the gate circuit 15 outputs data representative of "0" to the data input terminal of the shift register 16. This data representative of "0" is loaded into the shift register 16 by the clock pulse $\emptyset_1$ at time $t_{01}$, so that the loaded data representative of "0" is outputted from the data output terminal of the shift register 16 during a time period between time $t_{10}$ and time $t_{11}$ when the channel signal CH is "0". This output data representative of "0" is applied to the one data input terminal of the adder 13 and also to the other data input terminal of the adder 10 (FIG. 1) as the address data ADDa. At this time, the channel signal CH represents "0", and therefore the start address memory 9 outputs data representing the start address STAD of the area $\mathbf{1}_{-0}$ of the waveform memory 1 to the one data input terminal of the adder 10, this area $\mathbf{1}_{-0}$ storing the waveform data representative of the closed high-hat cymbals tone. Therefore, when the data representative of "0" is applied to the other data input terminal of the adder 10, this adder outputs the address data ADD representing the start address STAD of the closed high-hat cymbals tone area $\mathbf{1}_{-0}$ to the address input terminal AT of the waveform memory 1. As a result, the first data of the waveform data representing the closed high-hat cymbals tone is outputted from the waveform memory 1 and is applied to the third data input terminal of the multiplier 34.

When the data representative of "0" is applied to the one data input terminal of the adder 13 during the time period between $t_{10}$ and $t_{11}$, the adder 13 outputs data representative of "1" to the data input terminal B of the selector 14. At this time, "0" signal is being supplied from the comparator 4 to the selector terminal SA of the selector 14, so that the selector 14 outputs the data representing "1" and applied to the data input terminal B thereof to the input terminal of the gate circuit 15. At this time, "0" signal is being supplied to the terminal T5 of the address data generator 12 (FIG. 4), so that "1" signal is being supplied to the enabling terminal EN of the gate circuit 15. Therefore, the gate circuit 15 is in the open state, so that the data representative of "1" and outputted from the selector 14 is supplied to the input terminal of the shift register 16. Then, this data representing "1" is loaded into the shift register 16 by the clock pulse $\emptyset_1$ at time $t_{11}$ and then is outputted from the shift register 16 during a time period between time $t_{20}$ and time $t_{21}$. During this time period, the channel signal CH represents "0", so that the start address memory 9 outputs the data representing the start address STAD of the closed high-hat cymbals tone area $\mathbf{1}_{-0}$. Therefore, when the shift register 16 outputs the data representative of "1", the adder 10 outputs the address data ADD representing an address next to the start address of the closed high-hat cymbals tone area $\mathbf{1}_{-0}$ to the waveform memory 1, so that a second one of the waveform data representing the closed high-hat cymbals tone is read out of the waveform memory 1.

When the shift register 16 outputs data representative of "1", the adder 13 outputs data representative of "2" to the input terminal of the shift register 16 through the selector 14 and the gate circuit 15. The data representative of "2" is loaded into the shift register 16 by the clock pulse $\emptyset_1$ at time $t_{21}$, and then outputted therefrom during a time period between time $t_{30}$ and $t_{31}$ when the channel signal CH represents "0".

Then, in a similar manner, each time when the channel signal CH represents "0", the other waveform data representing the closed high-hat cymbals tone are sequentially read from the waveform memory 1 and applied to the multiplier 34. Then, it is assumed that the shift register 16 outputs data identical to data representative of the relative repeat address of the closed high-hat cymbals tone area $\mathbf{1}_{-0}$ during a time period between time $t_{k0}$ and time $t_{k1}$ when the channel signal CH represents "0". At this time, the repeat address memory 7 outputs data RPADa representative of the relative repeat address of the closed high-hat cymbals tone area $\mathbf{1}_{-0}$. Therefore, during the time period between time $t_{k0}$ and $t_{k1}$, the data applied respectively to the input terminals A and B of the comparator 8 coincide with each other, so that this comparator outputs the coincidence signal EQ2 ("1" signal) to the terminal T2 of the envelope generator 19. The coincidence signal EQ2 will be described in more detail later.

Then, the data representing the waveform of the closed high-hat cymbals tone are sequentially read from the waveform memory 1. It is assumed that the shift register 16 outputs data equal to data representative of the relative end address of the closed high-hat cymbals tone area $\mathbf{1}_{-0}$ during a time period between time $t_{m0}$ and $t_{m1}$ when the channel signal CH represents "0". At this time, the end address memory 3 outputs data ENADa representative of the relative end address of the closed high-hat cymbals tone area $\mathbf{1}_{-0}$. Therefore, the data applied respectively to the input terminsl A and B of the comparator 4 coincide with each other, so that this comparator 4 outputs the coincidence signal EQ1 ("1" signal) to the selector terminal SA of the selector 14 (FIG. 4). When the coincidence signal EQ1 is applied to the terminal SA of the selector 14 during the time period between time $t_{m0}$ and time $t_{m1}$, the repeat address data RPD outputted from the adder 6 and applied to the input terminal A of the selector 14 is outputted from the selector 14. This repeat address data RPD outputted during the time period between time $t_{m0}$ and time $t_{m1}$ when the channel signal is "0" represents the sum of the data designating the relative repeat address of the closed high-hat cymbals tone area and the random data RD. Therefore, this repeat address data RPD is outputted from the selector 14 and applied to the input terminal of the shift register 16 via the OR gate circuit 15. The repeat address data RPD is loaded into the shift register 16 by the clock pulse $\emptyset_1$ at time $t_{m1}$ and is then outputted from the shift register 16 during a time period between time $t_{(m+1)0}$ and time $t_{(m+1)1}$. Then, in a similar manner, each time the channel signal CH represents "0", the waveform data representing the closed high-hat cymbals tone (the one cycle portion B shown in FIG. 2) are sequentially read out of the waveform memory 1. And, when the shift register 16 again outputs data identical to the relative end address of the closed high-hat cymbals tone area, the repeat address data RPD is again loaded into the shift register 16. Then, the above operation is repeated.

The above-mentioned random data RD serves to slightly change the starting address, from which reading of the waveform data corresponding to the portion B is started, each time the data representative of the portion B are read from the waveform memory 1. The provision of the random data RD is due to the fact that if the waveform data corresponding to the portion B are repetitively read from the waveform memory 1 only in accordance with the repeat address data RPADa, a regular waveform is formed and the resultant rhythmic tone is therefore different in nature from that produced by the corresponding acoustic musical instrument particularly in the case of percussive musical instruments such as a cymbal. In this embodiment, the data RPADa representing the relative repeat address is modified by the random data RD to make the produced rhythmic tone be more close in nature to that of the corresponding acoustic musical instrument by eliminating regularity from the waveform of the generated rhythmic tone.

During the time period between time $t_{00}$ and time $t_{01}$, the rhythm pattern generator 21 generates "1" signal which is fed to the terminal T3 of the envelope generator 19 through the OR gate 42 whereupon the output of the inverter 45 (FIG. 5) is rendered "0", so that the outputs of the AND gates 46 and 53 are both rendered "0". At this time, the initial clear signal IC and the coincidence signal EQ2 are both in the state of "0", so that the OR gates 47 and 49 output "0" signals to the input terminals of the shift registers 25 and 24, respectively. These "0" signals are loaded into the shift registers 24 and 25, respectively, by the clock pulse $\emptyset_1$ at time $t_{01}$, and are outputted respectively from the shift registers 24 and 25 during the time period between time $t_{10}$ and time $t_{11}$. When the shift registers 24 and 25 output "0" signals, the OR gate 50 outputs "0" signal, so that the inverter 51 outputs "1" signal. As a result, the OR gate circuit 33 outputs data representative of "1 1 . . . 1 1" to the first data input terminal of the multiplier 34 via the terminal T1. At this time, as described above, the first waveform data representative of the waveform of the closed high-hat cymbals tone is being applied to the third data input terminal of the multiplier 34, while the correction data HD read from the amplitude memory 22 is being applied to the second data input terminal of the multiplier 34. At this time also, the rhythm code RC representative of eight-beat and the channel signal CH representative of "0" are being applied to the address input terminals AT1 and AT2 of the amplitude memory 22, respectively, so that the correction data HD represents one of the six kinds of correction data HD stored in the area 22*b* shown in FIG. 7 and corresponding to the closed high-hat cymbals tone. The correction data HD is selected from the six kinds of correction data in accordance with the position data and is hereinafter referred to as correction data HD1. Therefore, when the data representative of "1 1 . . . 1 1" is applied to the first data input terminal of the multiplier 34, this multiplier outputs data representative of the product of the first closed high-hat cymbals waveform data, the data representing "1 1 . . . 1 1" and the correction data HD1, and supplies the data representative of the product to the accumulator 35. Thereafter, each time the channel signal CH represents "0", the shift registers 24 and 25 output "0" signals, respectively, and the envelope generator 19 therefore outputs data representative of "1 1 . . . 1 1". And each time the channel signal CH represents "0", the waveform memory 1 outputs data representative of the closed high-hat cymbals waveform and the amplitude memory 22 outputs the correction data HD1. Therefore, each time the channel signal CH represents "0", the multiplier 34 outputs data representing the product of the closed high-hat cymbals waveform data, the data representing "1 1 . . . 1 1" and the correction data HD1 to the accumulator 35.

Then, when the comparator 8 outputs the coincidence signal EQ2("1" signal) to the other input terminal of the OR gate 47 (FIG. 5) during the time period between time $t_{k0}$ and time $t_{k1}$, the OR gate 47 outputs "1" signal to the input terminal of the shift register 25. This "1" signal is loaded into the shift register 25 by the clock pulse $\emptyset_1$ generated at time $t_{k1}$, and is outputted from the shift register 25 during a time period between time $t_{(k+1)0}$ and time $t_{(k+1)1}$ when the channel signal CH is "0". Thereafter, each time the channel signal CH represents "0", the shift register 25 outputs "1" signal. When the shift register 25 outputs "1" signal through the OR gate 50 to the input terminal of the inverter 51 during the time period between time $t_{(k+1)0}$ and time $t_{(k+1)1}$, the inverter 51 outputs "0" signal from the output terminal thereof. Also, when the shift register 25 outputs "1" signal to the enabling terminals EN of the gate circuit 29 and the envelope memory 30, the gate circuit 29 goes to open while the envelope memory 30 goes to the enabling state. At this time, the shift register 28 is outputting data representative of "0" to the address input terminal AT1 of the envelope memory 30. The data in the shift register 28 is changed after this time, as described later. Also, at this time, the channel signal CH representative of "0" is being applied to the address input terminal AT2 of the envelope memory 30. Therefore, when the envelope memory 30 goes to the enabling state during the time period between time $t_{(k+1)0}$ and time $t_{(k+1)1}$, the first envelope data ED corresponding to the closed high-hat cymbals tone is read from the area $30_{-0}$ (FIG. 6) of the envelope memory 30 and applied to the first data input terminal of the multiplier 34 via the OR gate circuit 33 and the terminal T1.

The data representative of "0" and outputted from the shift register 28 is applied to the other data input terminal of the adder 27. During this time period between time $t_{(k+1)0}$ and time $t_{(k+1)1}$, the output of the end address detector 31 is "0" signal, and therefore the inverter 32 is outputting "1" signal to the enabling terminal EN of the oscillator 26, so that the pulse signal generated by the oscillator 26 is being applied to the one data input terminal (LSB terminal) of the adder 27. When the output pulse signal of the oscillator 26 is "0" signal during the time period between time $t_{(k+1)0}$ and time $t_{(k+1)1}$, the output data of the adder 27 is "0". This output data is applied to the input terminal of the shift register 28 through the gate circuit 29 and is loaded thereinto by the clock pulse $\emptyset_1$ at time $t_{(k+1)1}$. This loaded data is outputted from the shift register 28 during a time period between $t_{(k+2)0}$ and time $t_{(k+2)1}$ when the channel signal CH represents "0". During this time period between time $t_{(k+2)0}$ and $t_{(k+2)1}$ the output of the shift register 25 is "1" signal and therefore in the manner described above, the first envelope data ED corresponding to the closed high-hat cymbals tone is read from the envelope memory 30 and is applied to the multiplier 34. Thereafter, until the output signal of the oscillator 26 goes to the "1" state, the above-mentioned operation is repeated when the channel signal CH is "0".

Then, when the output signal of the oscillator 26 goes to the "1" state, the adder 27 adds "1" to the output of the shift register 28 representative of "0". This addition result data representative of "1" is applied via the gate circuit 29 to the shift register 28 and is loaded thereinto. Thereafter, each time the channel signal represents "0", the shift register 28 outputs data representative of "1", so that the second envelope data ED corresponding to the closed high-hat cymbals tone is read from the envelope memory 30 and is applied to the multiplier 34. Then, when the output signal of the oscillator 26 again goes to the "1" state, the data representative of "2" is outputted from the adder 27 and is loaded into the shift register 28. Thereafter, the channel signal CH is "0", the third envelope data ED corresponding to the closed high-hat cymbals tone is read from the envelope memory 30 and is applied to the multiplier 34. Then, the above operation is repeated.

As described above, when the channel signal CH represents "0" after the coincidence signal EQ2 is generated, the envelope generator 19 sequentially reads the envelope data ED corresponding to the closed high-hat cymbals tone from the envelope memory 30 at an interval longer that the period of the clock pulse $\emptyset_1$ and supplies the envelope data ED to the multiplier 34. The reason for this is that the variation of the envelope does not need to be more complicated and delicate than the variation of the rhythmic tone waveform.

The data outputted from the shift register 28 when the channel signal CH represents "0" is increased gradually, and when the shift register 28 outputs the end address data representative of "1 1 . . . 1 1", the end address detector 31 detects this end address to apply "1" signal to the input terminal of the inverter 32. Therefore, "0" signal is applied to the enabling terminal EN of the oscillator 26, so that "0" signal is outputted from the oscillator 26 to the one data input terminal (LSB terminal) of the adder 27, and the data representative of "1 1 . . . 1 1" is applied to the input terminal of the shift register 28. Thereafter, each time the channel signal CH represents "0", the shift register 28 outputs the data representative of "1 1 . . . 1 1", so that the data representative of "0" is read from the end address of the area $30_{-0}$ of the envelope memory 30 and is applied to the multiplier 34. This condition is maintained until the rhythm pattern generator 21 outputs the next "1" signal when the channel signal CH represents "0", that is to say, until the rhythm pattern generator 21 outputs the next rhythm pulse ("1" signal) corresponding to the closed high-hat cymbals tone.

When the rhythm pattern generator 21 outputs the "1" signal through the channel signal CH of "0", this "1" signal is applied to the terminal T3 of the envelope generator 19, so that the envelope generator 19 outputs data representative of "1 1 . . . 1 1" to the first data input terminal of the multiplier 34. This condition is maintained until the comparator 8 outputs the coincidence signal EQ2 ("1" signal). During this period, the data representative of the attack portion A (See FIG. 2) of the closed high-hat cymbals tone waveform are sequentially read from the waveform memory 1 and are applied to the multiplier 34. After the comparator 8 outputs the coincidence signal EQ2, the envelope data ED corresponding to the closed high-hat cymbals tone is sequentially read from the envelope memory 30 at the interval greater than the period of the clock pulse $\emptyset_1$ and are applied to the multiplier 34. During this period, the data representative of the portion B (FIG. 2) of the closed high-hat cymbals tone waveform is repetitively read from the waveform memory 1 and is fed to the multiplier 34. The first address (the repeat address) of the area of the waveform memory 1 storing the data representative of the portion B is modified by the random data RD each time the data representative of the portion B is read from the waveform memory 1. After the data representative of "0" stored in the end address of the area $30_{-0}$ of the envelope memory 30 is read therefrom, this data is successively applied to the multiplier 34. In addition to the above operation, when the channel signal CH represents "0", the correction data HD1 is read from the amplitude memory 22. And the product of the output data of waveform memory 1, the output data of envelope generator 19 and the correction data HD1 is made by the multiplier 34, and the data representative of the product is sequentially applied to the accumulator 35.

The foregoing is the operation of the associated circuits of the apparatus shown in FIG. 1 when the channel signal CH represents "0". A similar operation is carried out when the channel signal CH represents one of "1" to "15". Therefore, for example, when the channel signal CH represents "1", the data representative of the open high-hat cymbals tone is outputted from the multiplier 34, and when the channel signal CH represents "2", the data representative the snare drum tone is outputted, and when the channel signal CH represents "15", the data representative of the cabasa tone is outputted. These data outputted from the multiplier 34, which have already been corrected by the corresponding correction data HD, are accumulated by the accumulator 35. The accumulated data is then converted into an analog signal, and this analog signal is supplied to the loudspeaker 39 through the variable resistor 37 and the amplifier 38.

As described above, the multiplier 34 multiplies the output data of the waveform memory 1 by the output data of the envelope memory 19, and further multiplies the result of this multiplication by the correction data HD. Therefore, the volume relationship of the respective rhythmic tone waveform data outputted from the multiplier 34 is always optimum irrespective of the position of the slider of the variable resistor 37, so that the rhythmic tones having the optimum volume relationship are produced by the loudspeaker 39.

The position detector 40 of this apparatus shown in FIG. 1 is constructed so as to detect the position of the slider of the variable resistor 37. However, in the case where this apparatus is incorporated in an electronic musical instrument having a keyboard and a variable resistor for simultaneously controlling both volumes of keyboard musical tones and the rhythmic tones, the position detector 40 may alternatively be constructed so as to detect the position of the slider of this variable resistor.

Figure 9:
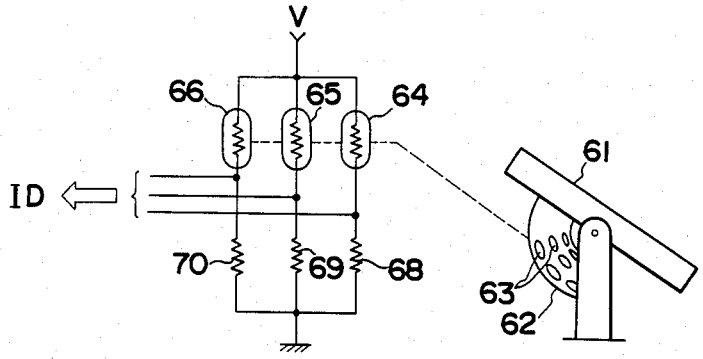
FIG. 9 is a circuit diagram of a modified position detector of the apparatus of FIG. 1.

Also, in the case where this apparatus is incorporated in an electronic keyboard musical instrument having an expression pedal for controlling the total volume of the rhythmic tones, the position detector 40 may be constructed so that it detects a signal corresponding to an amount of displacement of the expression pedal and converts the detected signal into the position code data ID. FIG. 9 shows so constructed position detector 40. Referring to this figure, an expression pedal 61 is pivotally mounted on a support member 71. An encoding plate 62 of a sector shape is fixedly secured to the expression pedal 61. A plurality of apertures 63 are formed through the encoding plate 62 in accordance with binary codes to be generated. A lamp (not shown) is provided on one side of the encoding plate 62 and CdS elements 64 to 66 are provided on the other side of the encoding plate 62 so that the elements 64 to 66 receive lights of the lamp passing through the apertures 63. Each of one terminals of the CdS elements 64 to 66 is connected to a power source +V, and the other terminals of the CdS elements 64 to 66 are connected respectively to one terminals of resistors 68 to 70. The other terminals of the resistors 68 to 70 are grounded.

With this construction, the resistibility of each of the CdS elements 64 to 66 goes either high or low in response to the amount of displacement of the expression pedal 61, so that the position code data ID representative of the amount of displacement of the pedal 61 is outputted from the respective junction points of the CdS elements 64 to 66 and the resistors 68 to 70.

What is claimed is:

1. An automatic rhythm performing apparatus capable of producing a plurality of rhythmic tones corresponding to a variety of rhythmic musical instruments, comprising:

(a) means for generating rhythmic tone signals for a variety of musical instruments;

(b) means for combining a plurality of said generated rhythmic tone signals thereby to provide a combined output signal as an output of said apparatus;

(c) means for varying the signal level of said combined output signal;

(d) means for detecting said signal level of the combined output signal; and (e) means responsive to said detecting means for controlling the respective signal levels of said rhythmic tone signals separately from each other in response to the detected level of said combined output signal, thereby to produce an optimum relationship between the rhythmic tone signals of said variety of musical instruments.

2. An automatic rhythm performing apparatus according to claim 1, in which said plurality of rhythmic tone generating means comprise (a) timing generator means for generating a rhythm timing signal corresponding to a desired rhythm, (b) storage means for storing a plurality of waveform data respectively representing tones of said rhythmic musical instruments and (c) means for respectively reading the plurality of waveform data from said storage means in accordance with said rhythm timing signal, the plurality of waveform data read from said storage means corresponding respectively to said rhythmic tone signals.

3. An automatic rhythm performing apparatus according to claim 2, in which said controlling means comprises (a) second storage means for storing a plurality of amplitude data representing signal levels of said rhythmic tone signals, different amplitude data being stored in the second storage means with respect to a same rhythmic tone signal and for different signal levels of said combined output signal, (b) means for reading one of said plurality of amplitude data in accordance with said rhythm timing signal and with the detected level of said combined output signal and (c) multiplier means for multiplying the waveform data read from said waveform storage means by the amplitude data read from said second storage means, data outputted from said multipier means corresponding to said plurality of rhythmic tone signals.

4. An automatic rhythm performing apparatus according to claim 3, in which said waveform data reading means, said amplitude data reading means and said multiplying means are constructed so as to operate in a time-sharing manner with respect to said plurality of rhythmic tones.

5. An automatic rhythm performing apparatus for use in an electronic keyboard musical instrument having an expression pedal, according to claim 1, in which said signal level varying means comprises said expression pedal.

6. An automatic rhythm performing apparatus according to claim 5, in which said detecting means comprises encoder means for converting an amount of displacement of said expression pedal to a code signal representing said amount of displacement. said code signal being supplied to said controlling means as said detected level of the combined output signal.

7. An automatic rhythm performing apparatus comprising:

means for generating independent tone signals representing a variety of musical instruments;

means for combining the signals to produce one output signal;

means for varying the level of the output signal; and means for detecting the level of the output signal and for altering each of said independent tone signals representing said variety of musical instruments based on the detected level of the output signal so as to produce at all output signal levels an optimum signal level relationship between the independent tone signals representing said variety of musical instruments.

8. The apparatus of claim 7 wherein said means for combining sequentially combines the respective signals from the means for generating and the respective data from the means for altering on a time sharing basis.

* * * * *